US007413322B2

(12) United States Patent
McCarthy

(10) Patent No.: US 7,413,322 B2
(45) Date of Patent: Aug. 19, 2008

(54) MODULAR SERVICE UNIT

(75) Inventor: Kenneth William McCarthy, Brisbane (AU)

(73) Assignee: Yanek Pty Ltd, Carina Heights (AU)

( * ) Notice: Subject to any disclaimer, the term of this patent is extended or adjusted under 35 U.S.C. 154(b) by 239 days.

(21) Appl. No.: 10/500,695

(22) PCT Filed: Dec. 20, 2002

(86) PCT No.: PCT/AU02/01731

§ 371 (c)(1),
(2), (4) Date: Feb. 7, 2005

(87) PCT Pub. No.: WO03/056240

PCT Pub. Date: Jul. 10, 2003

(65) Prior Publication Data

US 2005/0141216 A1 Jun. 30, 2005

(30) Foreign Application Priority Data

Jan. 4, 2002 (AU) ..... PR 9835
Feb. 21, 2002 (AU) ..... PS 0680

(51) Int. Cl.
*F21S 8/00* (2006.01)

(52) U.S. Cl. ..... 362/147; 362/150; 362/218; 362/225; 362/253

(58) Field of Classification Search ..... 362/147–148, 362/150, 218, 221, 225, 253, 404
See application file for complete search history.

(56) References Cited

U.S. PATENT DOCUMENTS 3,010,378 A * 11/1961 Geocaris ..... 454/236
3,090,434 A * 5/1963 Benson, Jr. ..... 165/50
6,443,592 B1 * 9/2002 Unger et al. ..... 362/147

FOREIGN PATENT DOCUMENTS

DE 19904933 C1 4/2000
GB 864894 A 4/1961
GB 1509259 A 5/1978
JP 09-204814 A 8/1997

* cited by examiner

*Primary Examiner*—Sandra O'Shea
*Assistant Examiner*—Jason Moon Han
(74) *Attorney, Agent, or Firm*—Krugliak, Wilkins, Griffiths & Dougherty Co., L.P.A.; David P. Dureska; Brent L. Moore

(57) ABSTRACT

Modular service unit (10A) comprising a pair of elongate light fitting EACH comprising a reflector housing (14) having one or more light tubes (24). Either a bridging plate, or an intermediate housing (26), is releasably attached to or supported by adjacent longitudinal side edges (34) of each reflector housing (14), and forms a structural part of an auxiliary service facility. The auxiliary service facility can include, for example, air conditioning ducts or diffusers, (17A), five alarm detectors, fire sprinklers with flexible pipe connections, speakers, security sensors, and secondary light fittings. A plurality of modular service units may be incorporated in a suspended ceiling.

22 Claims, 12 Drawing Sheets

MODULAR SERVICE UNIT

BACKGROUND OF THE INVENTION

This invention relates to a modular service unit for incorporation or installation in suspended ceilings or false ceilings.

Hitherto, suspended ceilings have been constructed on a basis wherein a grid of frame members or support members, often having a T-bar cross-section, were attached to overhead structures between side walls of a room of a building, and ceiling tiles or panels were then connected to the frame members so as to provide an aesthetic appearance. In the space between the frame members and a top wall or frame of the room were provided air conditioning ducts which were attached to plenum housings which expelled conditioned air into a room from outlets on grilles inclusive of air diffusers located in the ceiling tiles or panels. There were also provided fluorescent light fittings or troffers located at spaced intervals in the suspended ceiling as well as other service facilities such as fire alarm detectors, fire sprinklers, security equipment, speakers and spot light fittings or feature light fittings.

Troffers, when installed in a suspended ceiling were sometimes associated with plenum housings which were to be connected to air conditioning ducts and a first type of conventional service arrangement comprised a single troffer having a housing for one or more fluorescent light tubes whereby there was provided a pair of plenum housings or "air boots" as they are known in the art, wherein each air boot was supported on lower edge portions of the troffer housing and extended upwardly above the top of the troffer housing. Each air boot was interconnected by a hollow duct extending transversely to a longitudinal axis of the troffer housing. One of the air boots was provided with a hollow connection spigot for attachment to an air duct.

Disadvantages of the first type of conventional service arrangement described above was that it could only be efficiently used with a particular type of air diffuser for expulsion of conditioned air into the room. Thus it could only be used in an efficient manner with constant air diffusers and its use with variable air volume diffusers was restricted. It also could not be utilized with other service facilities, e.g., fire alarm detectors, fire sprinklers, speakers, spot light fittings, or feature light fittings, in an efficient manner.

In a second type of conventional service arrangement there was utilized a single light troffer which was located adjacent to an air conditioning apparatus which included a plenum housing, a base flange surrounding a bottom opening in the plenum housing and a connection spigot to an air duct. This second type of service arrangement was disadvantageous because installation was not only time consuming and expensive but it detracted from the overall appearance or aesthetics of a room to which it was installed. Also, like the first type of service arrangement described above, it could not be used in an efficient manner it utilized with other services such as those described above.

Reference may also be made to GB Patent 1 509 259 which refers to a combined illumination and ventilation device which comprises a plurality of profile elements. Each profile element has a reflector having a light tube combined therein. Each profile element also incorporated a trapezoidal channel which enclosed an elongate choke coil associated with the adjacent light tube. The trapezoidal channel is integral with the reflector. There is also provided a duct between each reflector and trapezoidal channel. Each reflector has a pair of integral bottom flanges one of which supports an air control flap which controls flow of air into or out of an adjacent duct.

The structure of GB Patent 1 509 259 is extremely complicated comprising a single modular unit which was the profile element as described above. Each of the profile elements are arranged in a side by side arrangement separated by each duct which has a button gap for entry or exit of air. In this arrangement there was also included a cover plant which interconnected each modular unit. Because of its complicated structure, the profile elements were only designed as a combined lighting and ventilation device and thus could not be adapted to incorporate other service facilities in lieu of ventilation.

Another disadvantage of the structure of GB Patent 1 509 259 was that it could not be utilized in conventional suspended ceilings having a grid of longitudinal T bars and transverse T bars.

Reference may also be made to other prior art references which combine an additional service facility with a lamp device and reference may be made to GB 864894, Japanese Patent Publication 04-188998, DE 3643075, U.S. Pat. No. 5,263,290 and U.S. Pat. No. 6,443,592, all of which suffer from the same disadvantages as GB 1 509 259, i.e., being of complicated construction and not being attachable to conventional suspended ceilings as described above.

SUMMARY OF THE INVENTION

It therefore is an object of the present invention to provide a modular service unit for installation in suspended ceilings or false ceilings which reduces the disadvantage(s) of the prior art discussed above.

The modular service unit of the invention comprising a pair of elongate light fittings comprising a reflector housing having one or more light tubes wherein each housing is channel shaped having an open bottom and is provided with a pair of longitudinal side edges adjacent the open bottom and a bridging plate or intermediate housing releasably attached to or supported by adjoining longitudinal side edges of each reflector housing wherein the bridging plate or intermediate housing forms a structural part of an auxiliary service facility. The auxiliary service facility can include for example, air conditioning outlets or diffusers, fire alarm detectors, fire sprinklers which are associated with flexible pipe connections, speakers, security equipment and other light fittings such as spot light fittings or feature light fittings.

The modular service unit of the invention may therefore include a pair of elongate light fittings such as light troffers which may each include a housing of relatively restricted width for incorporation of a single fluorescent light tube or multiple fluorescent tubes if appropriate. In one embodiment each troffer housing may be attached to, or be associated with, an intermediate housing which has a bottom outlet for incorporation of the other service facility. For example, this other service facility is air conditioning outlet which may include a plenum housing having a connection spigot for attachment to an air conditioning duct.

Each of the troffer housings and the intermediate housing may be connected together by any suitable connection means such as a pair of end plates or end frames. The width of the modular service unit of the invention provides stability for all components such as air diffuser boxes or plenum housings as well as semi-rigid components such as flexible pipework to sprinkler heads. Components such as air diffusers and grilles could be sized to fit the space between the light fittings. Smaller components may be mounded on a panel or plate which may constitute a preferred form of mounting means.

In one embodiment, the modular service unit of the invention may comprise a pair of light fittings and a bridging plate, or blank plate, which spaces the light fittings from each other.

The blank plate may have an outlet aperture and be used to support an immediate housing as described above or more preferably support an auxiliary service facility as shown in the preferred embodiment.

The use of a combined service modular unit provides stability for components such as linear air diffusers with plenum box and sprinkler heads with flexible pipework without secondary support from the overhead structure. Appropriate use of technology and materials will keep the weight of the module low enough to be supported by most T-bar ceilings. Module sizes can be selected to suit ceiling dimensions and performance requirements. For example, typical module sizes for a 1200 mm×600 mm ceiling grid are 600 mm×300 mm, 600 mm×400 mm, 600 mm×600 mm, 1200 mm×300 mm, 1200 mm×400 mm and 1200 mm×600 mm.

Location of all ceiling services components in discrete modules leaves the rest of the ceiling clear. This will reduce the need to penetrate ceiling tiles, increase flexibility for changes and reduce damage to ceiling tiles. The system can be adapted to most ceiling types including T-bar, concealed grid and fixed ceilings.

By using metric fluorescent tubes, modules can be installed in a continuous line in a metric grid ceiling. By using small diameter fluorescent tubes, e.g., T16 (16 mm diameter), fittings can be made with a low overall height thus minimizing ceiling space requirements.

BRIEF DESCRIPTION OF THE DRAWINGS

Reference may be made to a preferred embodiment of the invention as shown in the attached drawings which.

DESCRIPTION OF THE PREFERRED EMBODIMENTS

Figure 1:
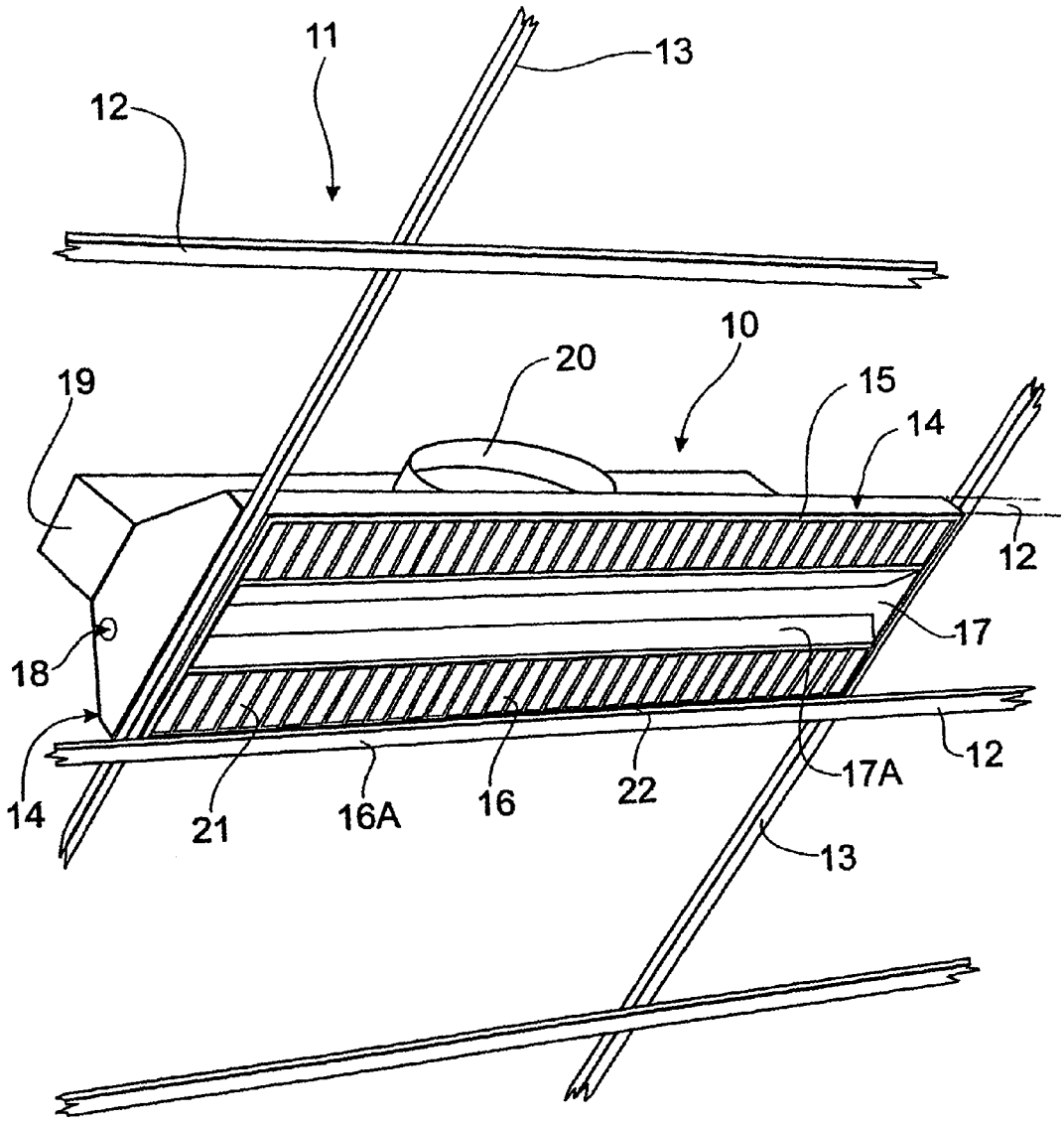
FIG. 1 is a perspective view of a modular service unit constructed in accordance with the invention.

In FIG. 1 the modular service unit 10 is fitted to a false ceiling or suspended ceiling 11, which comprises a grid or network of frame members in the form of longitudinal frame members such as T-bars 12 and transverse frame members such as T-bars 13. The modular service unit 10 comprises a pair of fluorescent light assemblies or troffers 14 having housings 15, light diffusers 16 and space 17 between diffusers 16. Each housing 14 as shown is channel shaped and more preferably having a shape of an inverted U having an open bottom 16A occupied by a diffuser 16. However, it will be appreciated that each troffer housing may be C shaped or V shaped in cross section. There is also provided a plenum housing 19 of rectangular cross-section which communicates with space 17 in which an aid diffuser 17A is introduced. Space 17 corresponds to an open bottom of plenum housing 19. A typical connection system such as end plates 18 is also shown. There is also provided a connection spigot 20 for attachment to an air duct (not shown) and which connection spigot 20 also communicates with housing 19. It will be noted that frame members 13 support service unit 10 by engaging with lower edges 21 of housing 15 and T-bars 12 support longitudinal edges 22 of housing 15. It will also be appreciated that ceiling panels (not shown) may be attached to frame members 12 and 13 in any suitable manner as is known in the art.

Figure 2:
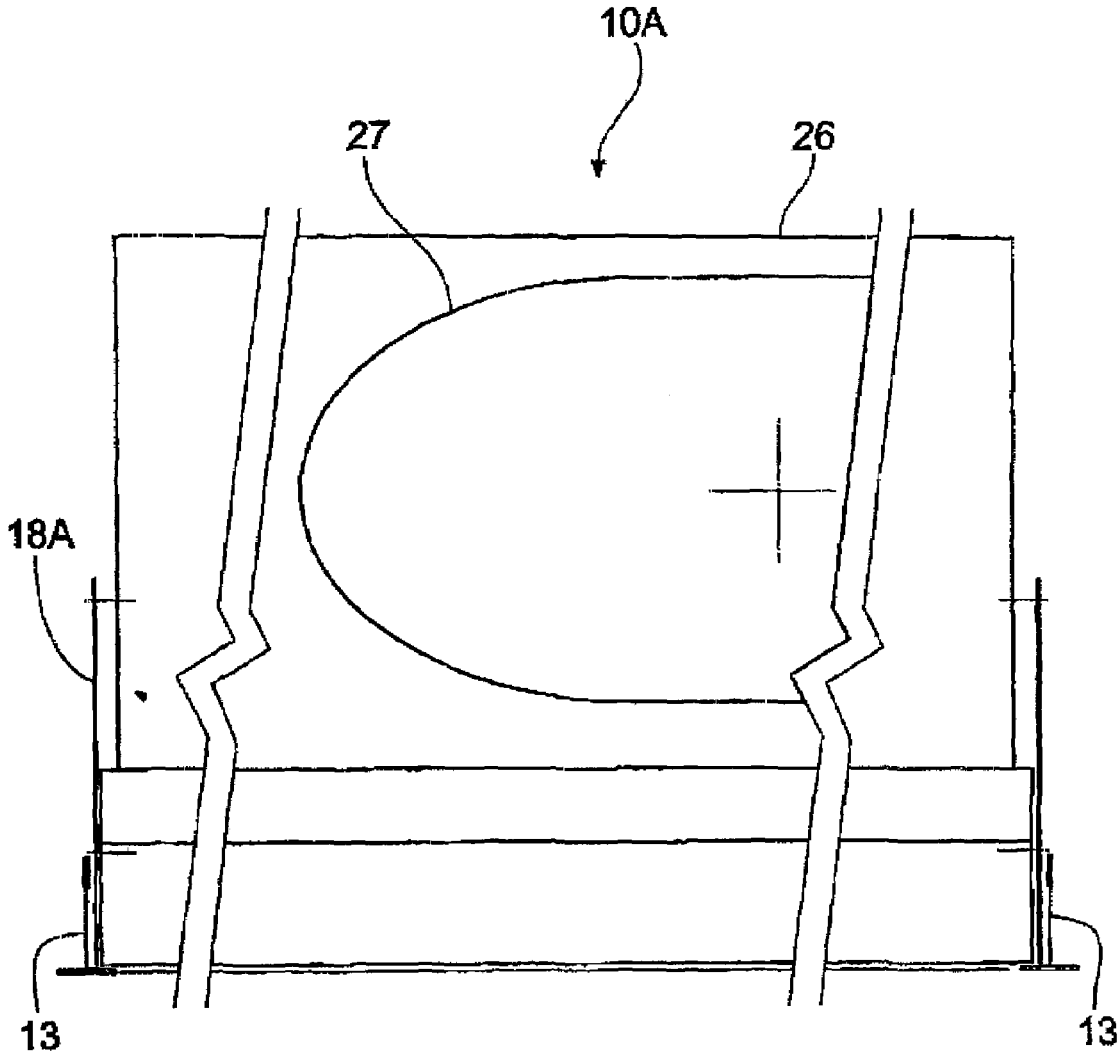
FIG. 2 is a side view of another modular service unit constructed in accordance with the invention.
Figure 3:
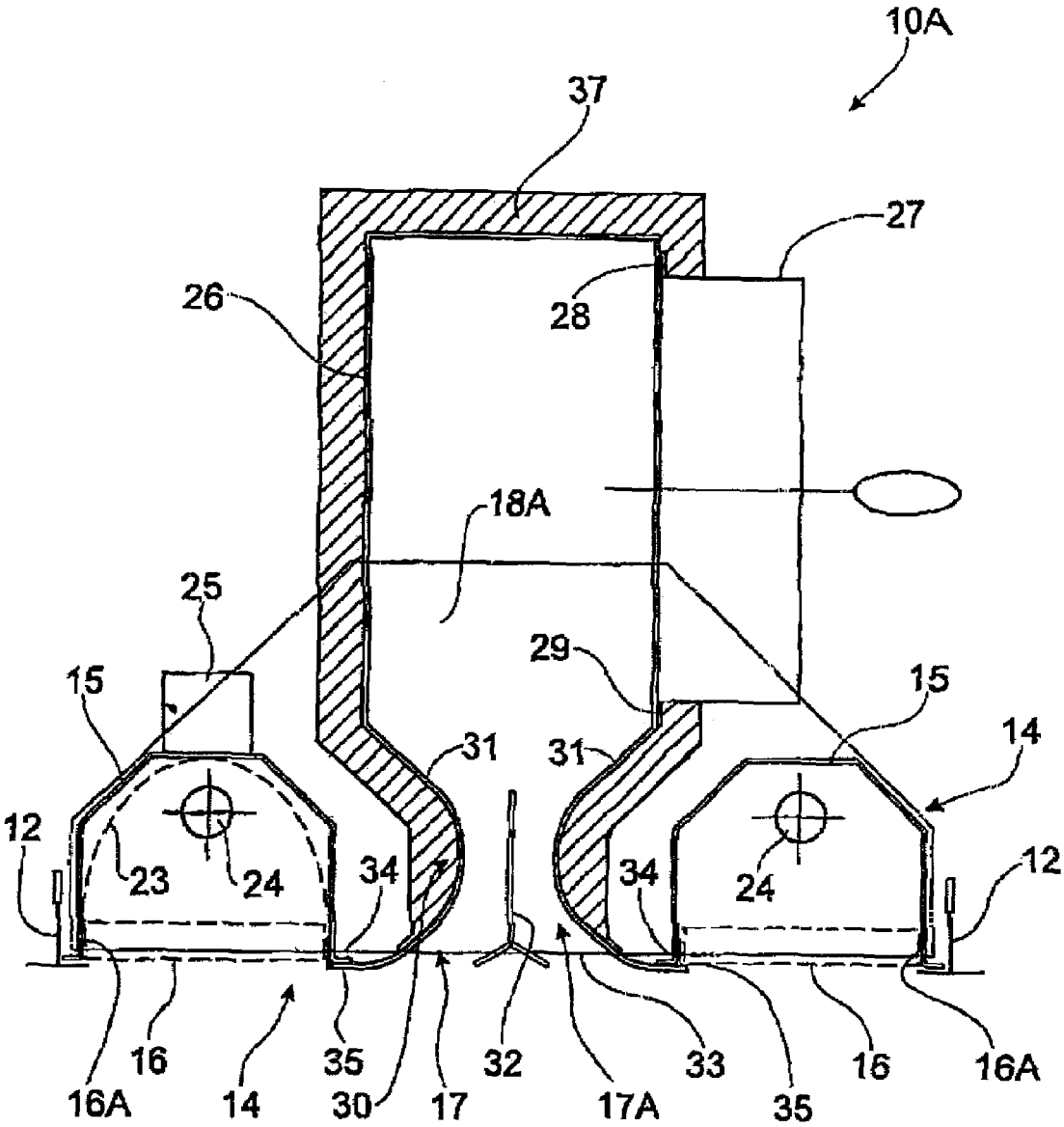
FIG. 3 is a sectional view of the modular service unit shown in FIG. 2.

In another embodiment shown in FIGS. 2-3 there is shown another modular unit 10A constructed in accordance with the invention wherein there is provided a pair of fluorescent light fitting or troffers 14 comprising housings 15, light diffusers 16, reflectors 23 and light tubes 24. There is also provided a ballast 25. A plenum housing 26 is shown having a connection spigot 27 to an air duct (not shown). The connection spigot 27 is adapted to be attached to housing 26 at 28 and 29. The housing 26 also has a lower portion 30 having arcuate side walls 31. An air baffle 32 is shown located in gap or space 33 between side walls 31. Usually the air diffuser 17A includes side walls 31, baffles 32 and air slots 33. Each of side walls 31 are supported by housing 14 by abutting longitudinal edge portions 34 and 35. There also may be incorporated appropriate fasteners (not shown) between adjacent edge portions 34 and 35. There is also provided a pair of end plates 18A which connect the various components of the modular unit 10A to each other, i.e., housing 26 and troffers 14. There is also provided insulation 37.

Figure 4:
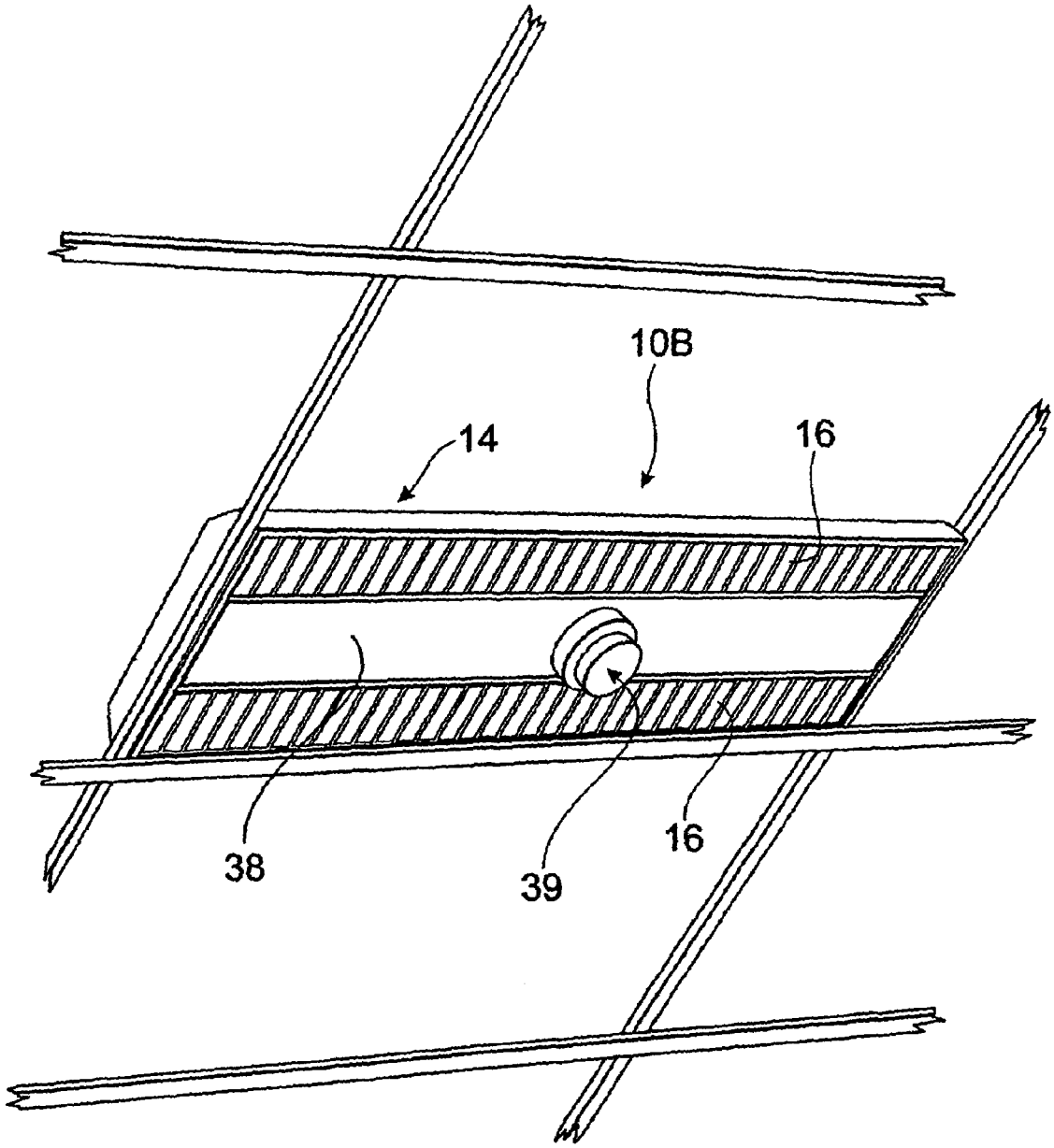
FIG. 4 is another embodiment of the invention.

In FIG. 4 there is shown another embodiment of the invention wherein modular service unit 10B includes a panel or bridging plate 38 between a pair of troffer housing 14 having associated light diffusers 16. There is also provided a fire detector 39.

Figure 7:
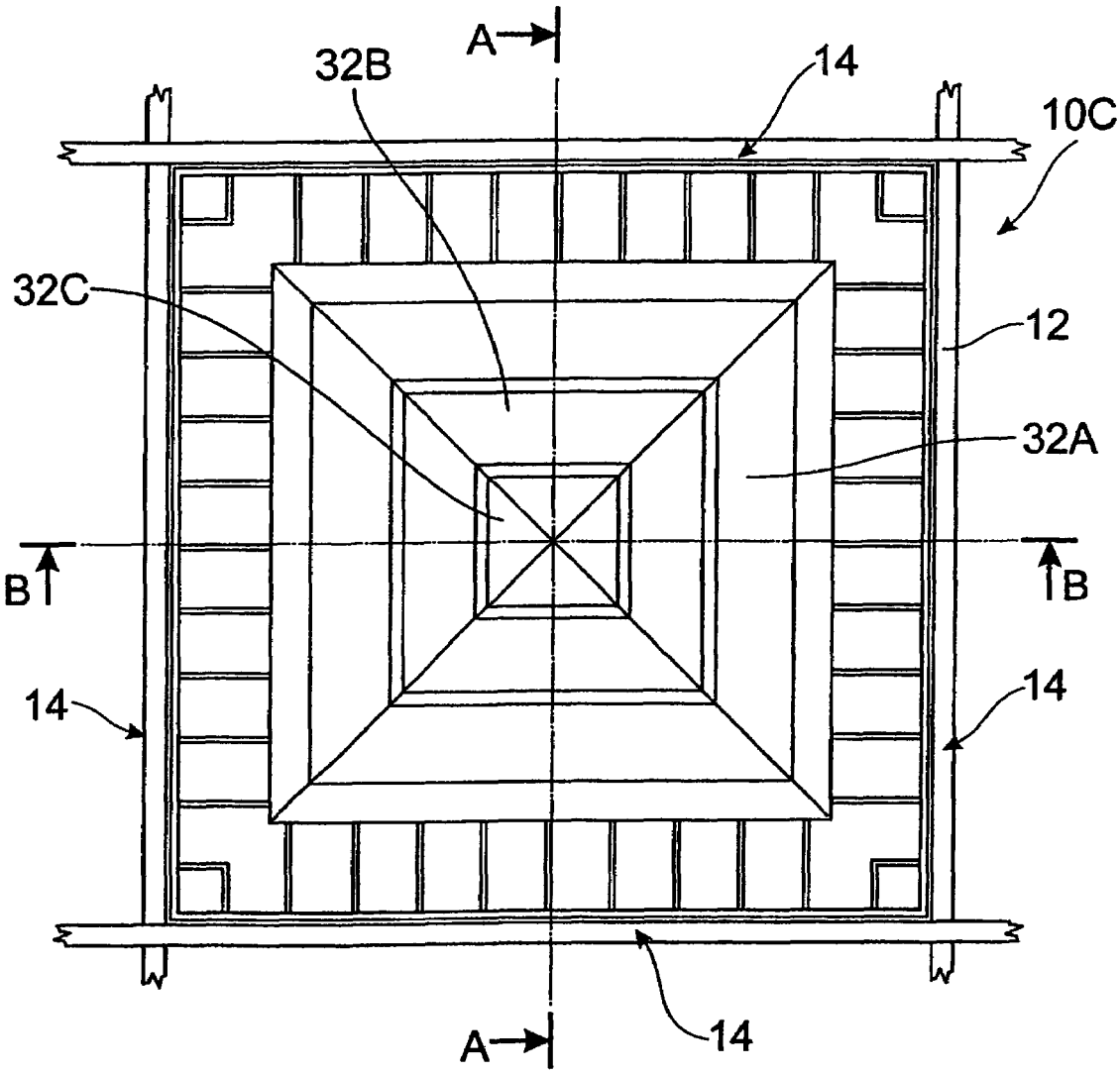
FIG. 7 is a plan view of another embodiment of the invention.
Figure 8:
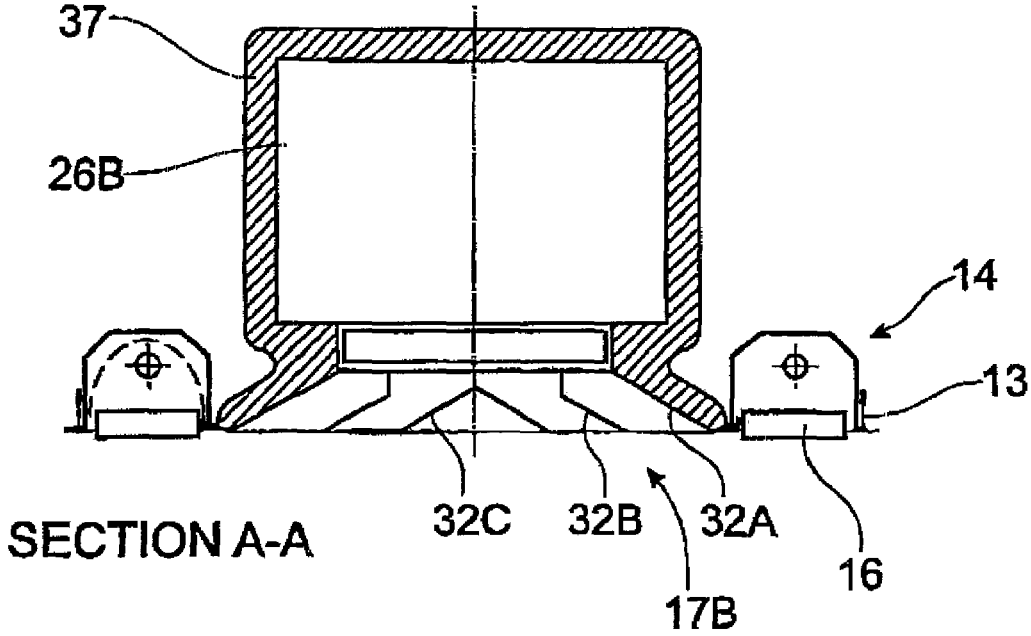
FIG. 8 is a section along line A-A of FIG. 7.
Figure 9:
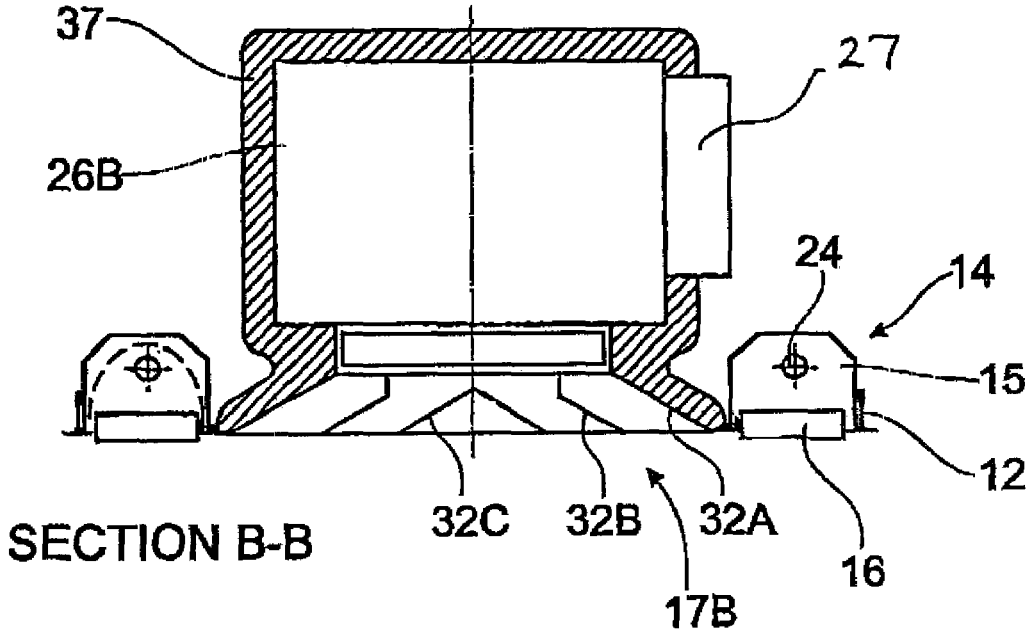
FIG. 9 is a section along line B-B of FIG. 7.

In another embodiment of the invention shown in FIGS. 7 to 9, reference is made to modular service unit 10C having a plenum housing 26B and connection spigot 27. There is also provided an air diffuser assembly 17B and baffles 32A, 32B and 32C. There are also provided troffers 14 located at each peripheral edge of modular service unit 10C and associated housings 15.

Thus, in this arrangement, it is shown that a modular service unit of the invention may comprise multiple light troffers, e.g., 4, which are preferably located along each peripheral edge of the modular service unit 10C.

Figure 10:
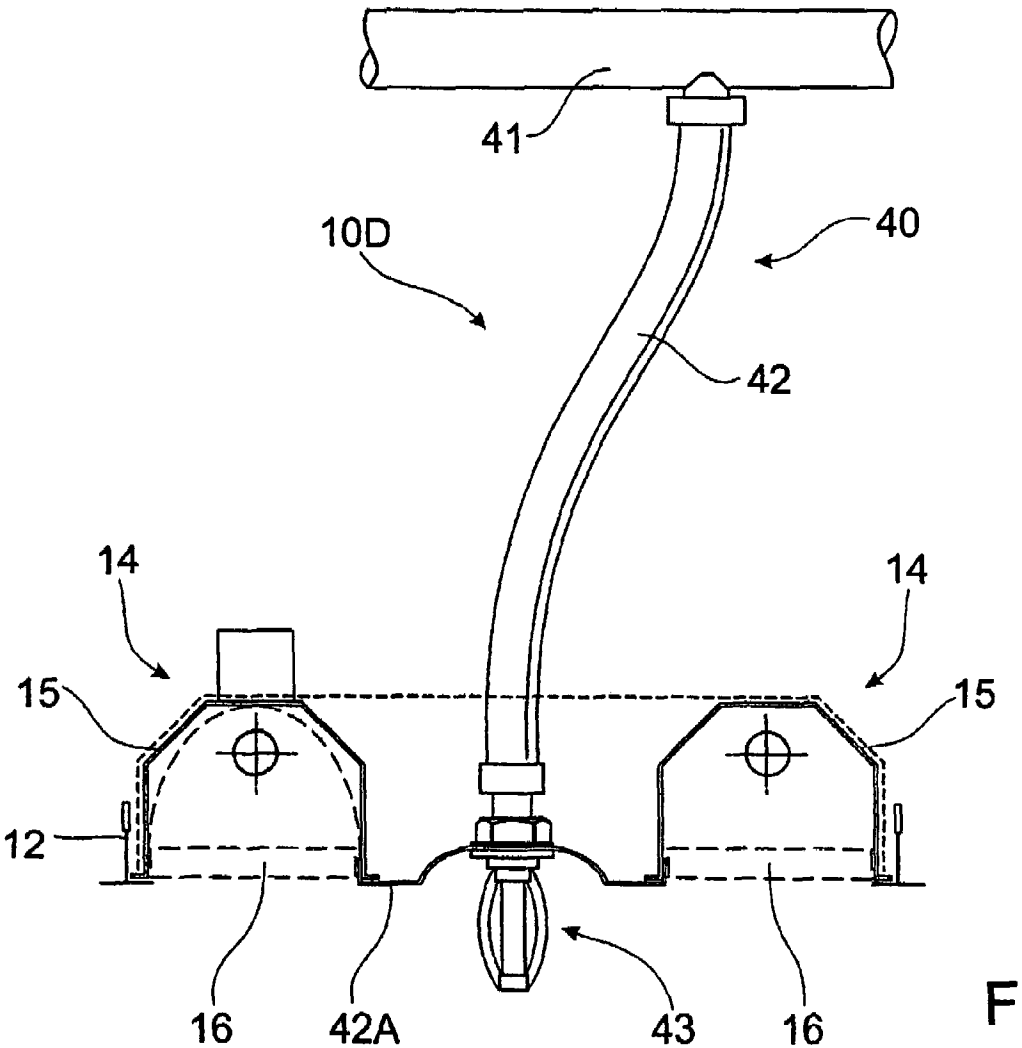
FIG. 10 is a sectional view of the modular service unit of the invention incorporating a file sprinkler application.
Figure 11:
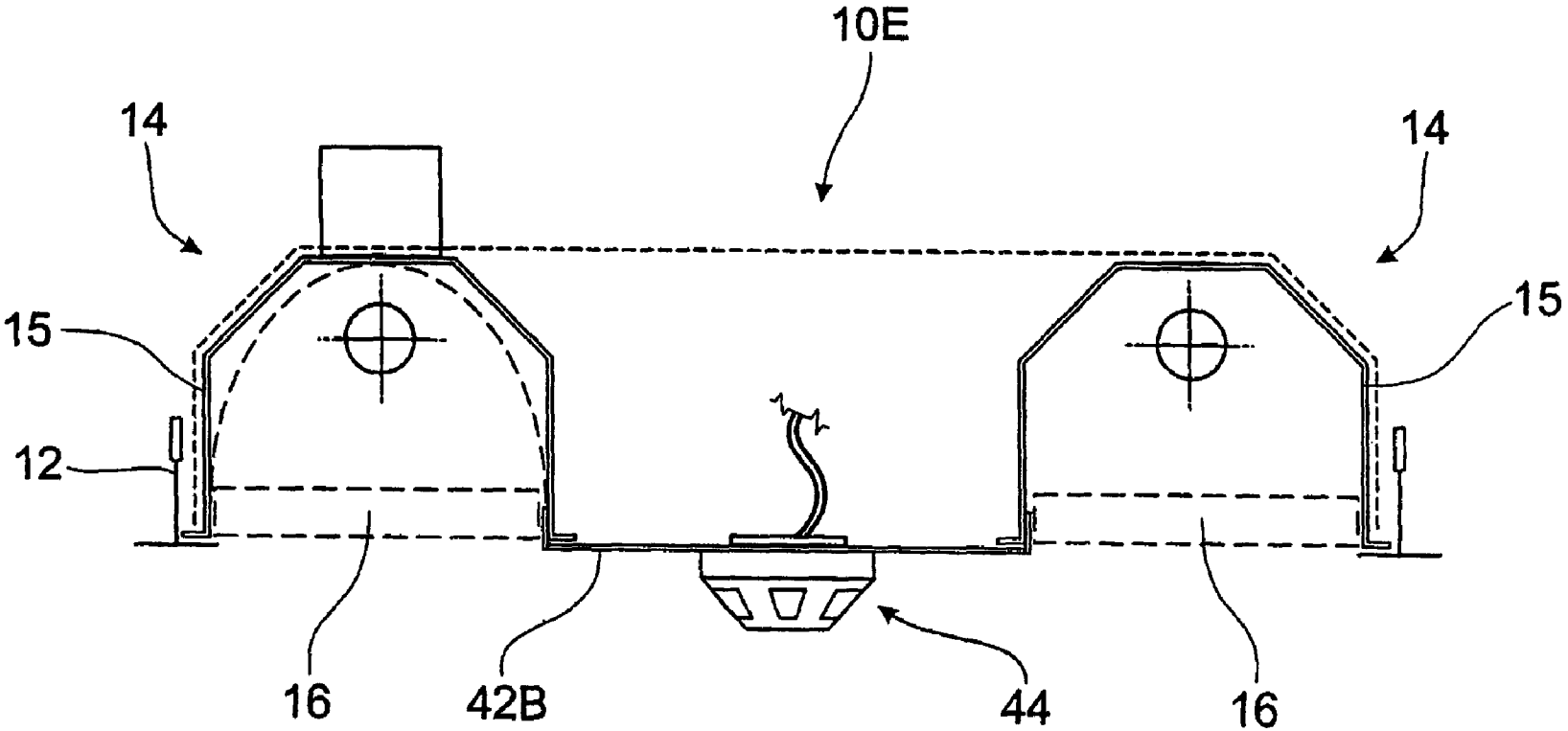
FIG. 11 is a sectional view of the modular service unit of the invention incorporating a fire detector application.
Figure 12:
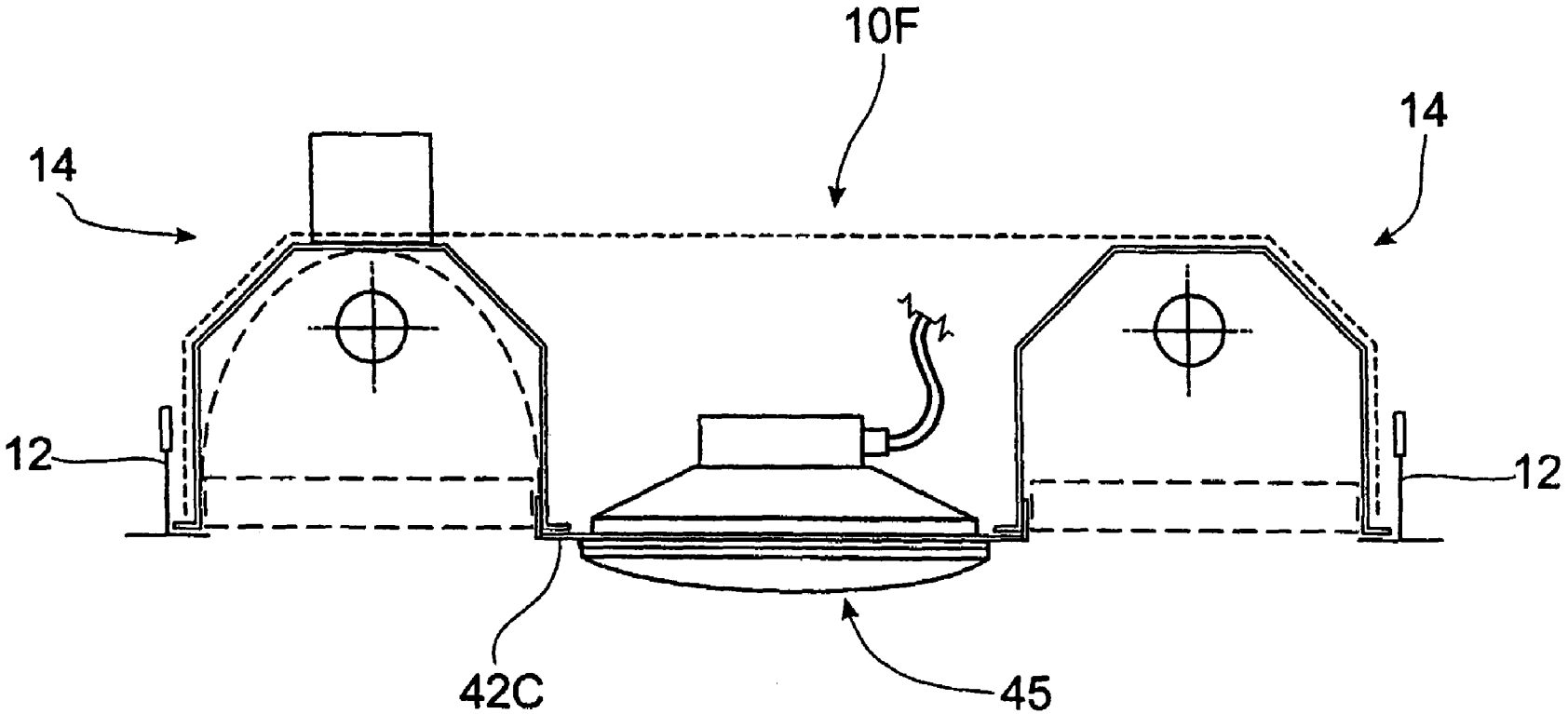
FIG. 12 is a sectional view of the modular service unit of the invention incorporating a speaker application.
Figure 13:
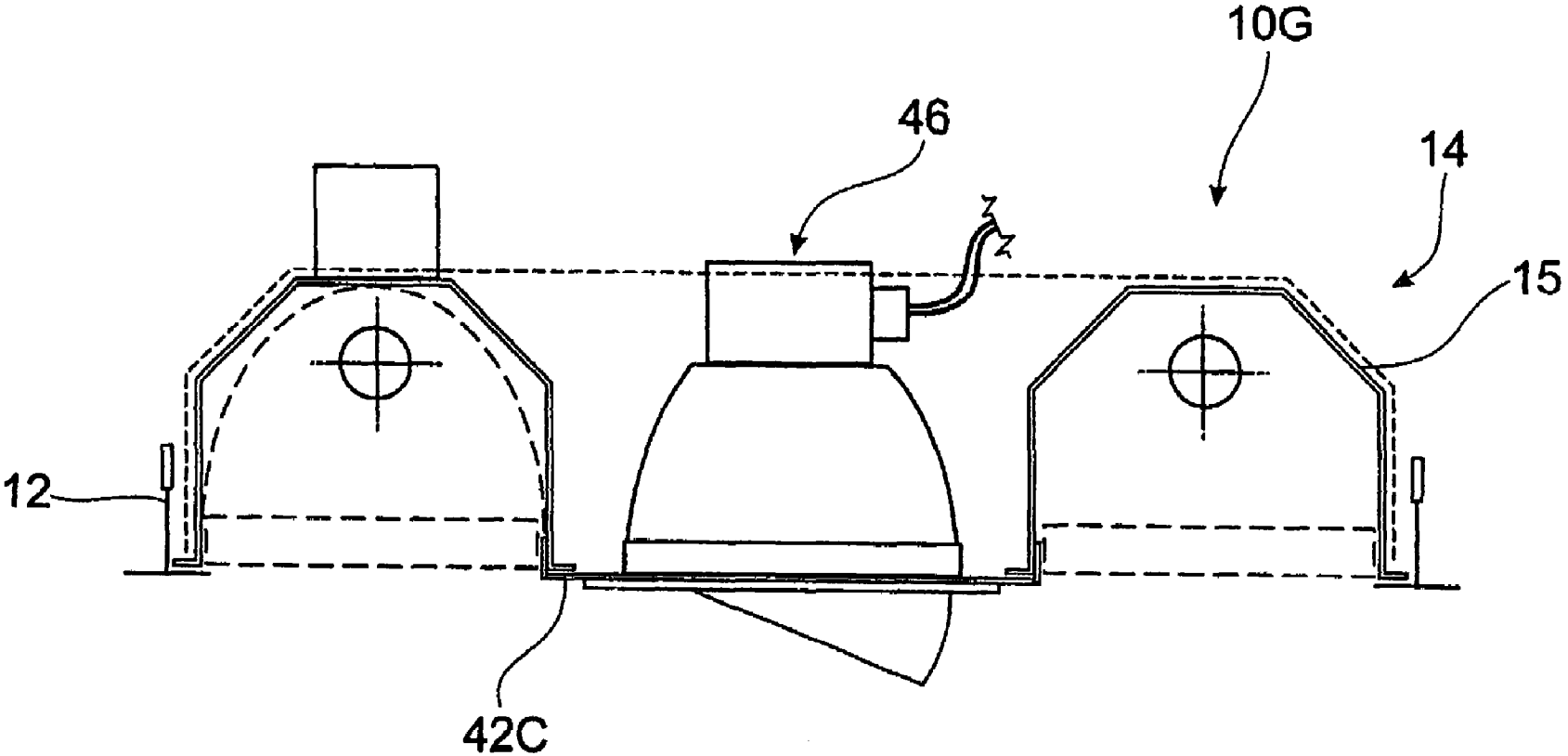
FIG. 13 is a sectional view of the modular service unit of the invention incorporating a secondary light fitting.

In FIGS. 10 to 13, reference is made to modular service units of the invention incorporating different services. Thus, FIG. 10 shows modular service unit 10D incorporating a fire sprinkler arrangement 40 having water conduit 41, hose 42 and sprinkler apparatus 43. There is also provided bridging or mounting plate 42A. FIG. 11 shows incorporation of fire detection apparatus 44 and mounting plate 42B. FIG. 12 shows incorporation of speaker apparatus 45 and mounting plate 42C. FIG. 13 shows incorporation of a secondary light fitting 46.

Figure 5:
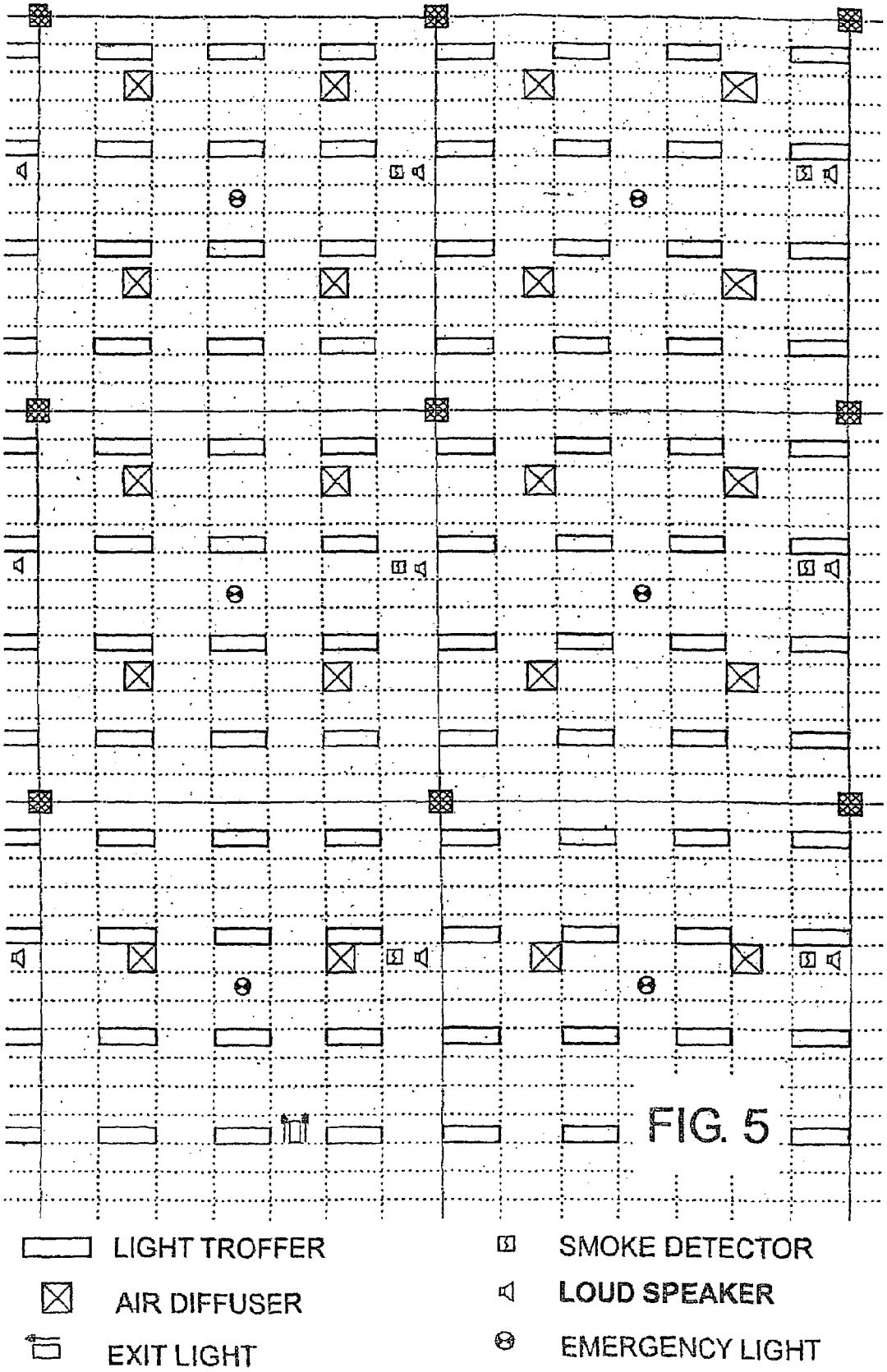
FIG. 5 is a plan view of a prior art suspended ceiling using the second type of conventional service arrangement discussed above.
Figure 6:
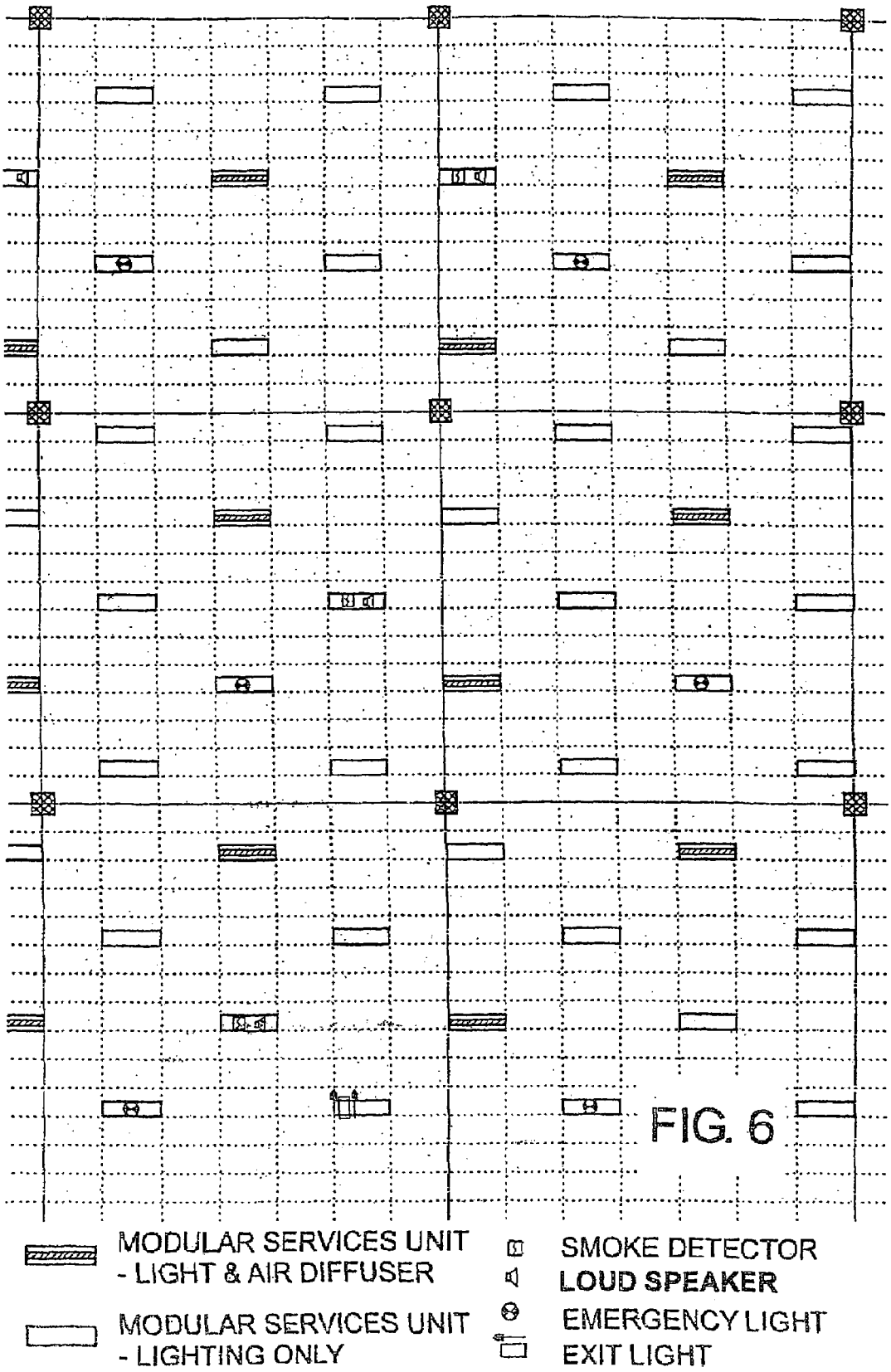
FIG. 6 is a plan view of a suspended ceiling incorporating modular service units of the invention.

From the foregoing it will be appreciated that the invention provides a modular service unit for incorporation in false ceilings or suspended ceilings which comprises a pair of light fittings separated by a space for other services as described above. This provides clear advantages over isolated and separate service units which are shown in the conventional suspended ceiling shown in FIG. 5. There may be a plurality of such modular units incorporated in a suspended ceiling as shown in FIG. 6 and this has the advantage of providing ceiling services in discrete modules which leaves the remainder of the ceiling clear of service facilities. This has the advantage of reducing the need to penetrate ceiling tiles, increasing flexibility for room layout changes and reducing damage to ceiling tiles or panels when said structural changes are carried out.

By using metric fluorescent tubes, modules can be installed in a continuous line in a metric grid ceiling. By using small discrete fluorescent tubes, fittings can be made with a low overall height thus minimizing ceiling space requirements.

Air diffusers may be of various types including variable air volume (VAV) type linear, VAV type rectangular and fixed volume types, as well as a return air grille to ceiling space or return air duct connection.

By grouping of relevant services in integrated modules the aesthetics of the ceiling is improved. By optimizing the modular unit of the invention from one supplier, appearance, finishes and colour are all controlled and matched.

From the foregoing and in consideration of the prior art referred to above, it will be appreciated that the invention provides a number of unique advantages, i.e., (a) each module unit has a pair of troffers separated by a bridging plate as shown in FIGS. 10-13 or an intermediate housing as shown in FIGS. 1-9. This is of simple structure allowing versatility in the use of any number of auxiliary services. Also this provides an arrangement involving the use of separate components which, in the case of FIGS. 1-9 embodiment, supply air insulated from light heat. In this regard, modern fluorescent tubes are optimized at higher temperatures and do not need cooling. This is a considerable advantage over GB Patent 1 509 259 where there is no provision for segregation or insulation, between air and light except a metal housing;

(b) the length of each modular unit 10 is defined by the length of tubes 24 to allow each installation into standard grid ceilings. Modules 10 can be repeated for additional length;

(c) in the case of the FIGS. 1-9 embodiment the air plenum 26 is a separate structure to the troffer housings allowing optimum design of both housings 14 and plenum 26;

(d) unlike GB 1 509 259, there is no requirement for a top housing above the reflector for light control gear. In the case of the module 10 a specific housing is not required and the gear may even be remote from the module 10;

(e) the FIGS. 1-9 embodiment can use proprietary linear air diffusers unlike GB 1 509 259 which provides for air control by a flap having a unique profile shape at the bottom of each reflector housing. Also, module 10 can use air diffusers configured to discharge air using the "COANDA" effect of aerodynamic attachment to the ceiling surface to improve the "throw" and increase air diffusion;

(f) in relation to the FIGS. 1-9 embodiment the ability to have a plenum housing to project above each light housing 14 facilitates the use of lateral connections to an air duct such as spigot 27.

The claims defining the invention are as follow:

1. A modular service unit comprising a pair of elongate light fittings each comprising a reflector housing having one or more light tubes, each one of said reflector housings being channel shaped and having an open bottom defined by a pair of longitudinal side edges each of which generally form lowermost surfaces of the reflector housing, said modular service unit further comprising a bridging plate or intermediate housing solely releasably attached to or substantially supported by adjoining ones of said lowermost surfaces, wherein said bridging plate or intermediate housing forms a structural part of an auxiliary service facility, so that said modular service unit can alternatively accommodate either said bridging plate or said intermediate housing in combination with said reflector housings.

2. A modular service unit as claimed in claim 1 wherein the intermediate housing forms a plenum housing which communicates with an air duct to thereby form said auxiliary service facility.

3. A modular service unit as claimed in claim 2 wherein the plenum housing has a connection spigot or socket which extends laterally of a longitudinal axis of the intermediate housing.

4. A modular service unit as claimed in claim 2 wherein the intermediate housing has a pair of lower side walls which are each located inwardly of a proximal reflector housing and spaced thereform.

5. A modular service unit as claimed in claim 4 wherein each of said lower side walls form a pair of planar upper side walls which then form a top wall of the intermediate housing.

6. A modular service unit as claimed in claim 5 wherein each of said lower side walls merge into an associated planar side wall above a top wall of each reflector housing.

7. A modular service unit as claimed in claim 6 wherein said intermediate housing incorporates a layer of insulation.

8. A modular service unit as claimed in claim 3 wherein said connection spigot or socket is releasably attached to an associated side wall of the intermediate housing.

9. A modular service unit as claimed in claim 2 wherein the intermediate housing has an open bottom.

10. A modular service unit as claimed in claim 9 which has an air baffle located adjacent or within the open bottom.

11. A modular service unit as claimed in claim 1 wherein the bridging plate supports fire sprinkler apparatus forming said auxiliary service facility having a water conduit, hose and sprinkler means located below the bridging plate.

12. A modular service unit as claimed in claim 1 wherein the bridging plate supports fire detection apparatus forming said auxiliary service facility.

13. A modular service unit as claimed in claim 1 wherein the bridging plate supports speaker apparatus forming said auxiliary service facility.

14. A modular service unit as claimed in claim 1 wherein the bridging plate supports a secondary light fitting which forms said auxiliary service facility.

15. A modular service unit as claimed in claim 1 having a pair of end plates wherein each end plate is attached to an adjacent end of a reflector housing.

16. A modular service unit as claimed in claim 2 having a pair of end plates wherein each end plates extends between each of the reflector housings and is attached to an adjacent wall of the plenum housing intermediate a top and bottom thereof.

17. A modular service unit as claimed in claim 11 having a pair of end plates wherein each end plate has approximately the same height as each reflector housing.

18. A modular service unit as claimed in claim 1 wherein each reflector housing has a top wall supporting a ballast for the light tube wherein the top wall is the sole support for the ballast therefore not requiring any other support structure.

19. A modular service unit as claimed in claim 1 having a length which is approximately the same as each reflector housing.

20. A suspended ceiling having a plurality of longitudinal support members and a plurality of transverse support members and a plurality of modular service units as claimed in claim 1 wherein all or some of each pair of adjacent longitudinal support members each support an outer side edge of an adjacent reflector housing of each modular service unit.

21. A suspended ceiling as claimed in claim 19 wherein each modular service unit is provided with a pair of end plates and all or some of each pair of adjacent transverse support members support a proximal end plate of a respective modular service unit.

22. A modular service unit comprising a pair of elongate light fittings each comprising a reflector housing having one or more light tubes, each one of said reflector housings being channel shaped and having an open bottom defined by a pair of longitudinal side edges each of which generally form lowermost surfaces of the reflector housing, said modular service unit further comprising a bridging plate or intermediate housing solely releasably attached to or substantially supported by adjoining ones of said lowermost surfaces, wherein said bridging plate or intermediate housing forms a structural part of an auxiliary service facility characterized in that each of said pair of elongate light fittings and said bridging plate or intermediate housing form a modular system of separate units releasably attached to each other so that said modular service unit can alternatively accommodate either said bridging plate or said intermediate housing in combination with said reflector housings.

* * * * *

UNITED STATES PATENT AND TRADEMARK OFFICE

CERTIFICATE OF CORRECTION

PATENT NO. : 7,413,322 B2
APPLICATION NO. : 10/500695
DATED : August 19, 2008
INVENTOR(S) : Kenneth William McCarthy It is certified that error appears in the above-identified patent and that said Letters Patent is hereby corrected as shown below:

Column 8, line 10, after the word "other" insert -- , --.

Signed and Sealed this

Eleventh Day of November, 2008

JON W. DUDAS
*Director of the United States Patent and Trademark Office*